US011002081B2

(12) United States Patent
Voronin

(10) Patent No.: US 11,002,081 B2
(45) Date of Patent: May 11, 2021

(54) POLYCRYSTALLINE DIAMOND CUTTER WITH HIGH WEAR RESISTANCE AND STRENGTH

(71) Applicant: Smith International, Inc., Houston, TX (US)

(72) Inventor: Georgiy Voronin, Orem, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/517,912

(22) Filed: Jul. 22, 2019

(65) Prior Publication Data

US 2020/0032590 A1 Jan. 30, 2020

Related U.S. Application Data

(60) Provisional application No. 62/702,383, filed on Jul. 24, 2018.

(51) Int. Cl.
*E21B 10/573* (2006.01)
*E21B 10/55* (2006.01)

(52) U.S. Cl.
CPC ..... *E21B 10/5735* (2013.01); *E21B 10/55* (2013.01)

(58) Field of Classification Search
CPC ..... E21B 10/5735
USPC ..... 175/432
See application file for complete search history.

(56) References Cited

U.S. PATENT DOCUMENTS

| | | | | |
|---|---|---|---|---|
| 2,941,241 | A | 6/1960 | Strong | |
| 2,941,248 | A | 6/1960 | Hall | |
| 2,947,611 | A | 8/1960 | Bundy | |
| 3,609,818 | A | 10/1971 | Wentorf, Jr. | |
| 3,767,371 | A | 10/1973 | Wentorf, Jr. et al. | |
| 4,289,503 | A | 9/1981 | Corrigan | |
| 4,673,414 | A | 6/1987 | Lavens et al. | |
| 4,954,139 | A | 9/1990 | Cerutti | |
| 5,469,927 | A | 11/1995 | Griffin | |
| 6,892,836 | B1 | 5/2005 | Eyre et al. | |
| 7,608,333 | B2 | 10/2009 | Eyre | |
| 2010/0196717 | A1* | 8/2010 | Liversage | C04B 37/021 428/408 |
| 2014/0062163 | A1* | 3/2014 | Jonker | B25D 17/02 299/79.1 |
| 2018/0044764 | A1* | 2/2018 | Bao | B22F 5/00 |

* cited by examiner

*Primary Examiner* — Taras P Bemko

(57) ABSTRACT

A cutting element has a thermally stable polycrystalline diamond layer formed on an upper side of a polycrystalline diamond layer. The cutting element has a cutting face opposite the polycrystalline diamond layer, a transition layer on a side of the polycrystalline diamond layer opposite the thermally stable polycrystalline diamond layer, and a non-planar interface between the transition layer and the polycrystalline diamond layer. The non-planar interface has a perimeter exposed around a side surface of the cutting element encircling an interior of the non-planar interface and an uppermost portion of the perimeter is a distance from the cutting face greater than an axial distance between the cutting face and the interior.

20 Claims, 5 Drawing Sheets

POLYCRYSTALLINE DIAMOND CUTTER WITH HIGH WEAR RESISTANCE AND STRENGTH

CROSS REFERENCE TO RELATED APPLICATION

This application claims priority to and the benefit of U.S. Provisional Application No. 62/702,383, filed Jul. 24, 2018, the entirety of which is incorporated herein by reference.

BACKGROUND

Drill bits used to drill wellbores through earth formations may include cutting elements attached at selected positions to the bit body. Cutting elements (sometimes referred to as cutters) may be formed having a substrate or support stud made of carbide, for example tungsten carbide, and an ultrahard cutting surface layer or "table" made of a polycrystalline diamond material or a polycrystalline boron nitride material deposited onto or otherwise bonded to the substrate at an interface surface.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In some embodiments, a cutting element has a thermally stable polycrystalline diamond layer at an upper side of a polycrystalline diamond layer. A cutting face is opposite the polycrystalline diamond layer. A transition layer is at a lower side of the polycrystalline diamond layer opposite the thermally stable polycrystalline diamond layer. A non-planar interface is between the transition layer and the polycrystalline diamond layer. The non-planar interface has a perimeter exposed around a side surface of the cutting element and encircling an interior portion of the non-planar interface, and an uppermost portion of the perimeter is a distance from the cutting face greater than an axial distance between the cutting face and the interior portion.

In some embodiments, a cutting elements has a diamond body with a leached portion at a cutting face of the cutting element and an unleached portion opposite. A transition layer is adjacent to the unleached portion of the diamond body. A non-planar interface is between the diamond body and the transition layer, the non-planar interface having a perimeter around a side surface of the cutting element. The perimeter of the non-planar interface is the axially lowermost portion of the non-planar interface from the cutting face.

In some embodiments, cutting elements have a cylindrical body with a cutting face, a side surface, a substrate, a transition layer on the substrate, a polycrystalline diamond layer at a first non-planar interface on the transition layer opposite the substrate, and a thermally stable polycrystalline diamond layer adjacent the polycrystalline diamond layer and opposite the transition layer. The thermally stable polycrystalline diamond layer forms the cutting face and a portion of the side surface. The first non-planar interface has a geometry with a downwardly sloped portion from an interior portion to a perimeter, the perimeter extending entirely around the side surface of the cutting element and being relatively farther from the cutting face than the interior portion.

Other aspects and advantages of the claimed subject matter will be apparent from the following description and the appended claims.

DETAILED DESCRIPTION

Embodiments disclosed herein relate generally to cutting elements having a reduced amount of exposed transition material between a polycrystalline diamond ("PCD") upper layer and a substrate. For example, cutting elements disclosed herein may generally include an upper PCD layer forming the cutting face of the cutting element, a substrate, and one or more transition layers disposed between the upper PCD layer and substrate, where a reduced amount of the transition layer is exposed to an outer side surface of the cutting element between the upper PCD layer and substrate. A portion of the upper PCD body in cutting elements according to embodiments of the present disclosure may be leached or otherwise have the catalyst removed, such that the entire cutting face of the cutting element is thermally stable polycrystalline diamond ("TSP").

Figure 1:
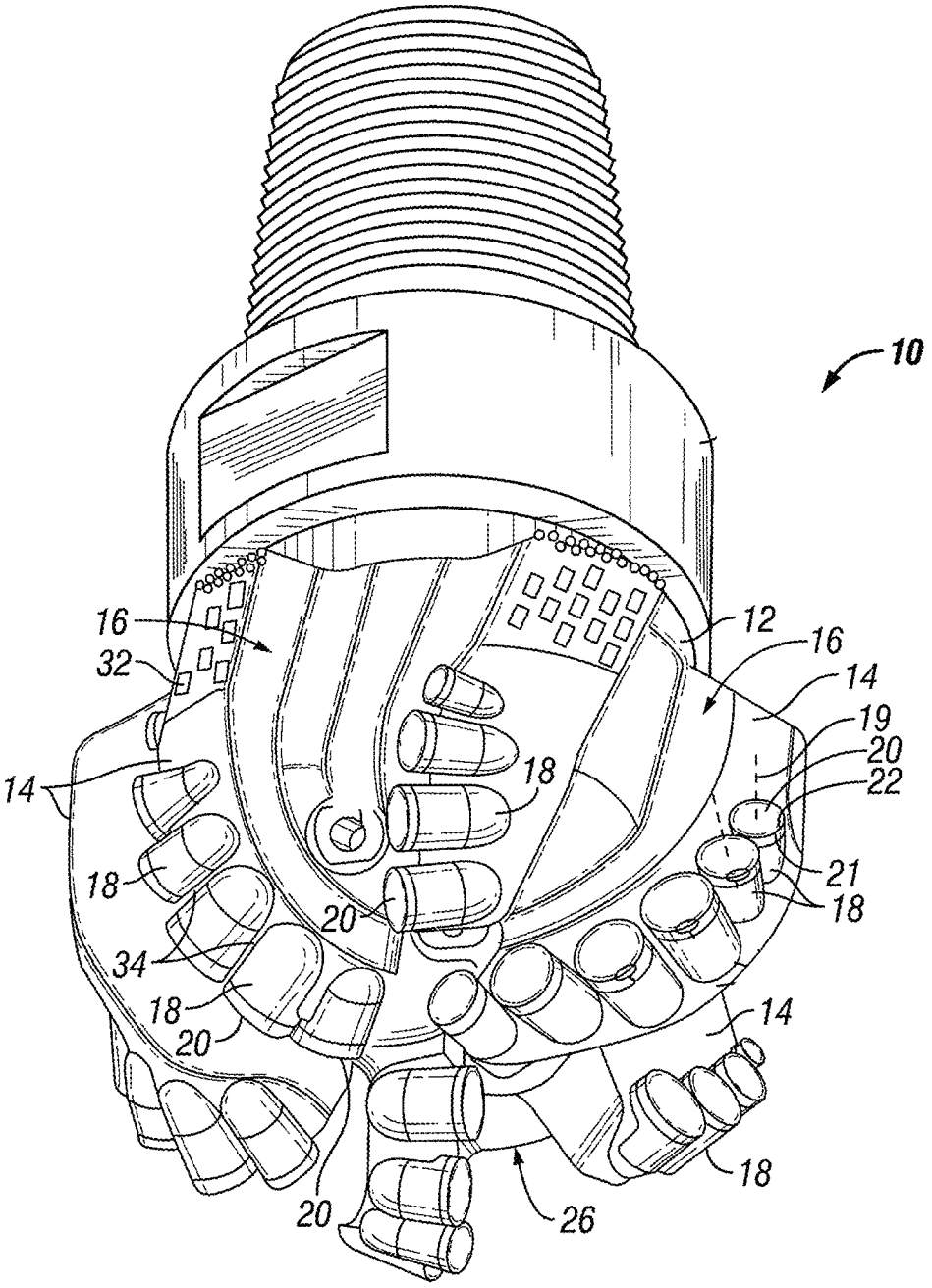
FIG. 1 shows a drill bit having cutting elements disposed thereon according to embodiments of the present disclosure.

An example of a fixed cutter drill bit having a plurality of cutters with ultrahard working surfaces (also referred to as cutting faces) is shown in FIG. 1. A drill bit 10 includes a bit body 12 and a plurality of blades 14 that are formed on the bit body 12. The blades 14 are separated by channels or gaps 16 that enable drilling fluid to flow between and both clean and cool the blades 14 and cutters 18. Cutters 18 are held in the blades 14 at predetermined angular orientations and radial locations to present cutter working surfaces 20 with a desired back rake angle and side rake angle against a formation to be drilled. Typically, the cutting faces 20 are generally perpendicular to the axis 19 and side surface 21 of a cylindrical cutter 18. Thus, the cutting face 20 and the side surface 21 meet or intersect to form a circumferential cutting edge 22.

The combined plurality of cutting faces 20 of the cutters 18 effectively forms the cutting face of the drill bit 10. Once the crown 26 of the bit is formed, the cutters 18 are positioned in pockets 34 formed in the bit and affixed by any suitable method, such as brazing, adhesive, mechanical means such as interference fit, or the like. The design depicted provides the pockets 34 inclined with respect to the surface of the crown 26. The pockets 34 may be inclined such that cutters 18 are oriented with the cutting face 20 at a desired rake angle in the direction of rotation of the bit 10, so as to enhance cutting. The cutting elements used in the bit may include cutters as more fully described herein.

In some embodiments, a cutting element may have a transition layer disposed on a lower side of a PCD layer and/or a TSP layer disposed on an upper side of the PCD layer opposite the transition layer, where the TSP layer forms a cutting face of the cutting element. A non-planar interface may be formed between the transition layer and the PCD layer, where the perimeter of the non-planar interface is exposed around a side surface of the cutting element and encircles an interior portion of the non-planar interface. An uppermost portion of the perimeter may be a distance from the cutting face greater than an axial distance between the cutting face and the interior portion.

In some embodiments, a cutting element may include a diamond body with a leached portion along a cutting face of the cutting element and an unleached portion, a transition layer adjacent to the unleached portion of the diamond body, and a non-planar interface formed between the diamond body and the transition layer, where a perimeter of the non-planar interface extending around a side surface of the cutting element may be the axially lowermost portion of the non-planar interface from the cutting face. As used herein, a diamond body, or portions of a diamond body, may be referred to as layers, where the term "layer" may be used to describe general arrangements of different diamond portions. For example, a diamond body may be described as having one or more diamond layers, e.g., a TSP layer and a PCD layer.

As used herein, "polycrystalline diamond" or "PCD" refers to a plurality of interconnected diamond crystals and interstitial spaces among them in which a metal or non-metal component (such as a solvent-catalyst) may reside. The interconnected diamond crystal structure of PCD may include direct diamond-to-diamond bonding and/or bonding of diamond to another material such as silicon carbide. The interconnected diamond crystal structure of PCD may often be referred to as forming a lattice or matrix structure. Particularly, a catalyst material (e.g., a metallic or non-metallic catalyst), such as cobalt or magnesium carbonate, may be used to promote re-crystallization of the diamond crystals, wherein the diamond grains are regrown together to form the lattice structure, thus leaving particles of the remaining catalyst within the interstitial spaces of the diamond lattice. Additionally, according to some embodiments of the present disclosure, PCD material may also include boron dopants.

As used herein, "thermally stable polycrystalline diamond" or "TSP" refers to a plurality of interconnected diamond crystals having a thermal stability greater than that of conventional PCD. For example, TSP may be formed by removing substantially all metal from the interstitial spaces between interconnected diamond crystals of PCD, by various known methods such as acid leaching, heat treatment, or the like, depending on the type of catalyst used. Alternatively, rather than removing the catalyst material from PCD, the selected region of the PCD can be rendered thermally stable by treating the catalyst material in a manner that reduces or eliminates the potential for the catalyst material to adversely impact the PCD structure at elevated temperatures. For example, the catalyst material can be combined chemically with another material to cause it to no longer act as a catalyst material, or can be transformed into another material that again causes it to no longer act as a catalyst material. Accordingly, as used herein, the terms "removing substantially all" or "substantially free" as used in reference to the catalyst material is intended to cover the different methods in which any catalyst material can be treated to no longer adversely impact the intercrystalline diamond in the PCD body or compact with increasing temperature.

Possible transitional layer (e.g., transition layer) materials include PCD materials different from the upper PCD layer, as well as other hard and ultrahard materials. Transition layer usually, but not necessarily, have properties intermediate between the PCD upper layer and the substrate of a cutting element. For example, transitional layers may be formed of a mixture of diamond particles and a constituent in the substrate material, such as metal binder and transition metal carbide or carbonitride particles. Suitable materials for forming a substrate and/or for mixing in a transitional layer may include, for example, carbides, nitrides, carbonitrides, borides or a mixture thereof formed from refractory metals such as tungsten, tantalum, titanium, chromium, molybdenum, vanadium, niobium, hafnium, zirconium, or mixtures thereof. Example materials include WC, TiC, TiN, TiCN, TaC, $TiB_2$, or $Cr_2C_3$. The metal binder that may be used to bind the particles of abovementioned materials together (thereby forming a cermet composite) may be ductile materials including one or a combination of Co, Ni, Fe, which may be alloyed with each other or with C, B, Cr, Si, or Mn. Example cermets that form the substrate include cemented tungsten carbide with cobalt as the binder phase (WC—Co) or other cermets such as WC—Ni, WC—Fe, WC—(Co, Ni, Fe) and alloys thereof. Further, as mentioned, such materials may also be provided in one or more transitional layers. A transition material may include, for example, an amount of carbide or other hard material (such as those used in the substrate) ranging from about 2 percent to about 80 percent by volume (with diamond and optional metal as the remaining components of the transition material).

Introduction of a transitional layer with a coefficient of thermal expansion ("CTE") greater than that of an upper PCD layer may decrease detrimental residual stresses close to a carbide substrate and helps to improve the cutting element's resistance to spalling and delamination. The transitional layer may also have a higher strength due to larger diamond grain size and/or higher volume fraction of cobalt or other ductile metal, which can also improve the cutting element's resistance to spalling. However, transitional layers usually have lower wear resistance and/or thermal stability than the upper PCD layer, which may result in lower wear resistance and thermal stability of the whole cutting element.

Moreover, in the case of leached cutting elements, use of one or more transitional layers may cause additional problems, such as if the transitional layer(s) have a larger volume fraction of cobalt and/or other metals, leaching the metals out of the transition layer results in the PCD structure with high porosity and low strength. In addition, if there is a significant difference in the structure and/or phase content of multiple PCD layers, it may result in a significant difference of the speed of leaching through the PCD layers and in non-uniformity of the leaching depth in the area of the borderline between the layers, which in turn may be detrimental for the cutting element's strength and/or wear resistance.

In some embodiments, wear resistance and strength of a leached cutting element is improved by forming a cutting element with a non-planar interface between the upper PCD layer and the transitional layer that bends downwards near the cutting element's side surface. Such interface geometry may result in more favorable distribution of residual stresses at the side surface, thus improving the cutting element's spalling resistance. It may also result in a limited exposure of a transitional layer to the cutting element's side surface even in the case of a protruding interface between the transitional layer and an adjacent substrate. It also may allow leaching of a majority of the PCD upper layer exposed at the side surface of the cutting element, while also avoiding leaching a transitional layer (e.g., by leaving a remaining unleached portion of PCD between the leached portion of the PCD material and the transition layer). As a result, problems conventionally arising from use of transitional layers in leached cutting elements may be avoided.

Cutting elements of the present disclosure designed to have a reduced amount of transitional layer material exposed to the side surface of the cutting element may also delay exposure of less wear resistant and/or less thermally stable transitional layer to the wear process, thus improving the cutting element's overall wear resistance and thermal stability.

Figure 2:
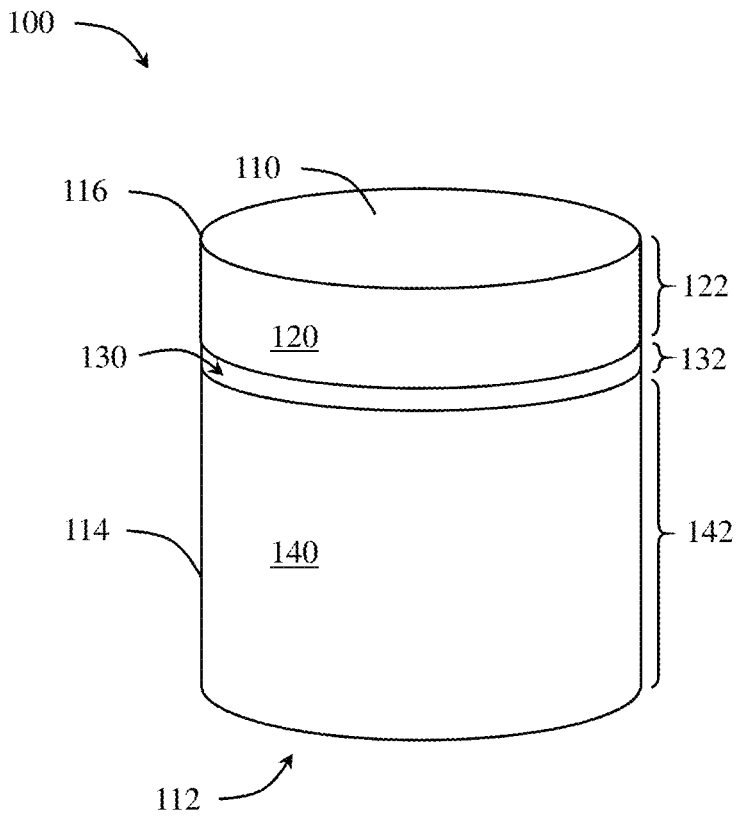
FIG. 2 is a perspective view of a cutting element according to embodiments of the present disclosure.

FIG. 2 shows an example of a cutting element having a limited amount of exposed transitional layer material according to embodiments of the present disclosure. The cutting element 100 has a cylindrical body with a cutting face 110 as the uppermost side of the cutting element, a base surface 112 opposite the cutting face, and a side surface 114 extending from the cutting face 110 to the base surface 112. A cutting edge 116 is formed where the cutting face 110 and side surface 114 meet.

A PCD upper layer 120 forms the cutting face 110 and a portion of the side surface 114 extending a first distance 122 axially from the cutting face 110. The first distance 122 may be uniform around the entire circumference of the side surface 114. However, in one or more embodiments, it is envisioned the PCD body 120 may extend a non-uniform first distance around the circumference of the side surface 114. In one or more embodiments, the PCD upper layer 120 may have a first distance 122 (or thickness at the side surface) that ranges, for example, from 0.05 to 0.20 inches or from 0.08 to 0.12 inches in one or more particular embodiments. A transitional layer 130 is disposed between the PCD body 120 and a substrate 140. The exposed portion of the transitional layer 130 (at the side surface 114) may extend axially a second distance 132 from the PCD upper layer 120 and around the entire circumference of the side surface 114. It is envisioned that the exposed portion (exposed to the side surface 114) of the transitional layer 130 may extend a uniform second distance or may extend a non-uniform second distance around the circumference of the side surface. The substrate 140 may form the remaining portion of the side surface 114, extending a third distance 142 axially from the base surface 112. The third distance 142 may be uniform or non-uniform around the circumference of the side surface 114.

The transitional layer 130 may have a thickness greater than zero across the entire cross-sectional area of the cutting element, such that the PCD upper layer 120 does not contact the substrate 140. Unexposed portions of the transitional layer 130 may have a thickness greater than the second distance 132 of the exposed portion of the transitional layer. For example, in one or more embodiments, the unexposed portions of the transitional layer 130 (such as at the central axis of the cutter) may range from 0.02 inches to 0.06 inches.

The PCD layer(s) of the cutting element 100 may be formed, for example, by high pressure high temperature ("HPHT") sintering of diamond grains in the presence of a suitable catalyst or binder material, such as one or more elements from Group VIII of the Periodic table or a carbonate solvent catalyst, to achieve intercrystalline bonding between the diamond grains. Layers of powdered material for the substrate, transition layer(s), and/or PCD upper layer and/or preformed bodies of the substrate, transition layer(s), and/or PCD body may be layered and placed in a reaction cell of a HPHT apparatus. For example, methods of forming the cutting element may include layering a pre-formed substrate or powdered substrate material, one or more layers of transition material adjacent the substrate material, and a mass or volume of diamond grains within a reaction cell of a HPHT apparatus. A metal solvent catalyst material may be included in the reaction cell to promote intercrystalline diamond-to-diamond bonding between diamond crystalline particles. The catalyst material may be provided in the form of powder and mixed with the diamond grains, or may be infiltrated into the diamond grains during HPHT sintering, for example, from the substrate and/or transition material. A suitable HPHT apparatus for this process is described in U.S. Pat. Nos. 2,947,611; 2,941,241; 2,941,248; 3,609,818; 3,767,371; 4,289,503; 4,673,414; and 4,954,139. The contents of the reaction cell (the mass of diamond grains, metal catalyst, transition material and substrate material) may be subjected to HPHT conditions, which may conventionally include a minimum temperature of about 1200° C. and a minimum pressure of about 35 kbars, and typically temperatures between about 1300-1500° C. and pressures between about 45-60 kbar.

Upon forming the cutting element 100 shown in FIG. 2, a portion of the PCD upper layer may be leached to form a TSP layer. The TSP layer may extend a depth into the PCD body 120 from the cutting face 110 and from a portion of the side surface 114 extending axially a fourth distance from the cutting face 110 (which may be less than the first distance 122, discussed above, in relation to the PCD upper layer). In such embodiments, after the leaching process, the TSP layer may form the cutting face, cutting edge, and an uppermost portion of the side surface of the cutting element.

A leaching process may include contacting a portion of a PCD body with a leaching agent, such as an acid, for a duration of time. For example, referring again to FIG. 2, a portion of the PCD upper layer 120 outer surface (including the cutting face 110 and a portion of the side surface 114 extending a partial depth from the cutting face 110) may be exposed to a leaching agent, such as by dipping the portion of the PCD upper layer 120 in the leaching agent. In some embodiments, the outer surfaces of the cutting element 100 which do not require leaching (such as transition layer 130 and substrate 140, and a portion of PCD upper layer 120) may be masked off prior to exposing the portion of the PCD upper layer to a leaching agent. The portion of the PCD upper layer 120 selected to form a TSP layer may be exposed to a leaching agent for a duration of time sufficient for the leaching agent to remove a catalyst material within the PCD upper layer 120 extending a depth from the outer surfaces being exposed to the leaching agent (including the cutting face 110 and a portion of the side surface 114 extending axially a fourth distance from the cutting face 110). It is envisioned that the PCD body 120 may be leached by inserting the cutting element into a protective fixture such as that described in U.S. Pat. No. 7,608,333, which is assigned to the present assignee and herein incorporated by reference.

A leaching agent may be a weak, strong, or mixtures of acids. In other embodiments, the leaching agent may be a caustic material such as NaOH or KOH. Suitable acids may include, for example, nitric acid, hydrofluoric acid, hydrochloric acid, sulfuric acid, phosphoric acid, or perchloric acid, or combinations of these acids. In addition, other acidic and basic leaching agents may be used as desired. Those having ordinary skill in the art will appreciate that the molarity of the leaching agent may be adjusted depending on the desired leaching time, concerns about hazards, etc. Further, accelerated leaching techniques may be used to treat a PCD body, such as application of increased temperatures, pressures, ultrasound, etc.

According to embodiments of the present disclosure, a cutting element may have a diamond layer disposed at a non-planar interface on a transition layer, where the non-planar interface may have a geometry with a downwardly sloped portion from an interior portion to a perimeter, the perimeter extending entirely around the side surface of the cutting element and being relatively farther from the cutting element's cutting face than the interior portion of the non-planar interface.

In some embodiments, cutting elements may be formed of multiple layers of different materials, where intermediate layers between a substrate and an upper layer of the cutting element have non-planar upper surface profiles, thereby forming a non-planar interface with an adjacent layer in the cutting element. One or more non-planar interfaces between two or more adjacent layers of material may have a downwardly sloped portion from an interior portion to a perimeter of the non-planar interface, with the perimeter being relatively farther from the cutting face than the interior portion.

For example, a PCD layer may be disposed at a first non-planar interface on a transition layer, where the first non-planar interface may have a geometry with a downwardly sloped portion from an interior portion to a perimeter of the cutting element, the perimeter being relatively farther from the cutting element's cutting face than the interior portion of the first non-planar interface. A second non-planar interface may be formed between a TSP layer and the PCD layer, where the second non-planar interface may also have a geometry with a downwardly sloped portion from an interior portion to a perimeter of the second non-planar interface. The perimeter of the second non-planar interface may extend entirely around the side surface of the cutting element and may be relatively farther from the cutting face than the interior portion of the second non-planar interface. Downwardly sloped portions of non-planar interfaces within a cutting element may have the same or different slopes. In some embodiments, a first slope of the downwardly sloped portion of a first non-planar interface between a transition layer and a PCD layer may be less than a second slope of the downwardly sloped portion of a second non-planar interface between a TSP layer and a PCD layer.

In some embodiments, a cutting element may have a non-planar interface between a transition layer and a substrate, where the non-planar interface may have a geometry with a downwardly sloped portion from an interior portion to a perimeter of the non-planar interface. The perimeter of the non-planar interface may extend entirely around the side surface of the cutting element and may be relatively farther from the cutting face than the interior portion.

Non-planar interfaces having downwardly sloped portions from the interior of the interface to a perimeter of the interface may have a stepped cross-sectional profile, where the perimeter is stepped down from the interior portion of the non-planar interface in a position that is relatively farther from the cutting face of the cutting element than the interior portion of the non-planar interface. Downwardly sloped portions of non-planar interfaces may include a stepped profile having angular or rounded turns from the interior portion of the non-planar interface to the perimeter of the non-planar interface.

According to embodiments of the present disclosure, a non-planar upper surface of one or more intermediate layers in a cutting element may include a step between the perimeter of the upper surface and an interior portion of the upper surface. Intermediate layers may have the same stepped upper surface profile (where the geometries of the upper surfaces are the same), or intermediate layers may have different stepped upper surface profiles. For example, a first intermediate layer may have an upper surface profile with a step having a first slope, and a second intermediate layer may have an upper surface profile with a step having a second slope different from the first slope.

Figure 3:
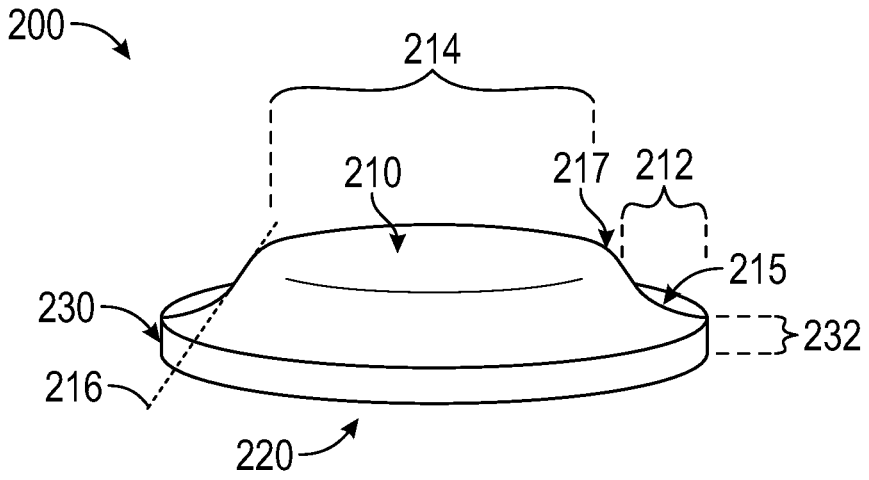
FIG. 3 is a perspective view of an intermediate layer in a cutting element according to embodiments of the present disclosure.

FIG. 3 shows an example of an intermediate layer 200 in a cutting element according to embodiments of the present disclosure. The intermediate layer 200 has a non-planar upper surface 210 opposite a base surface 220 and an outer side surface 230 extending a thickness 232 between the perimeters of the upper surface 210 and the base surface 220. The upper surface 210 includes a downwardly sloped portion 212 extending between the perimeter of the upper surface 210 and an interior portion 214 of the upper surface, where the downwardly sloped portion 212 has a stepped profile. The interior portion 214 of the transition layer 200 is a raised portion interior to and protruding a height above the perimeter of the transition layer 200. The interior portion 214 may be centered in the radial center of the transition layer 200, or an interior portion may be off-center from the radial center of a transition layer. Further, as shown, the interior portion 214 may extend a uniform height along the entire interior portion from the perimeter of the upper surface 210. In some embodiments, an interior portion may extend a non-uniform height from the perimeter of the upper surface of the transition layer. For example, in some embodiments, an interior portion may have an undulated surface geometry, one or more dimples and/or protrusions, or a sloped surface geometry.

The downwardly sloped portion 212 may have curved turns. For example, a first turn 215 may have a concave profile from the perimeter of the upper surface 210 going toward the interior portion 214 with a first radius of curvature, and a second turn 217 may have a convex profile transitioning from the downwardly sloped portion 212 to the interior portion 214 with a second radius of curvature. In some embodiments, turns of a stepped portion may be angled. The downwardly sloped portion 212 may have sloped portion between the two turns 215, 217 having a first slope 216. A sloped portion may have a constant slope around the perimeter of an interior portion of a transition layer. In some embodiments, a sloped portion may have a varied slope around the perimeter of an interior portion of a transition layer.

According to one or more embodiments of the present disclosure, the base surface of a transition layer may have corresponding geometry with the upper surface of the transition layer, such that the transition layer has a uniform thickness across the entire radial cross-sectional area of the transition layer. In some embodiments, the geometry of the base surface of a transition layer may be different than the geometry of the upper surface of the transition layer, such that the thickness of the transition layer varies across the radial cross-sectional area. For example, a base surface of a transition layer may be planar, and an upper surface of the transition layer may have a surface geometry with a raised interior portion. In some embodiments, a base surface of a transition layer may be non-planar and different from a non-planar upper surface of the transition layer, thereby creating a non-uniform thickness of the transition layer across the entire radial cross-sectional area of the transition layer.

Figure 4:
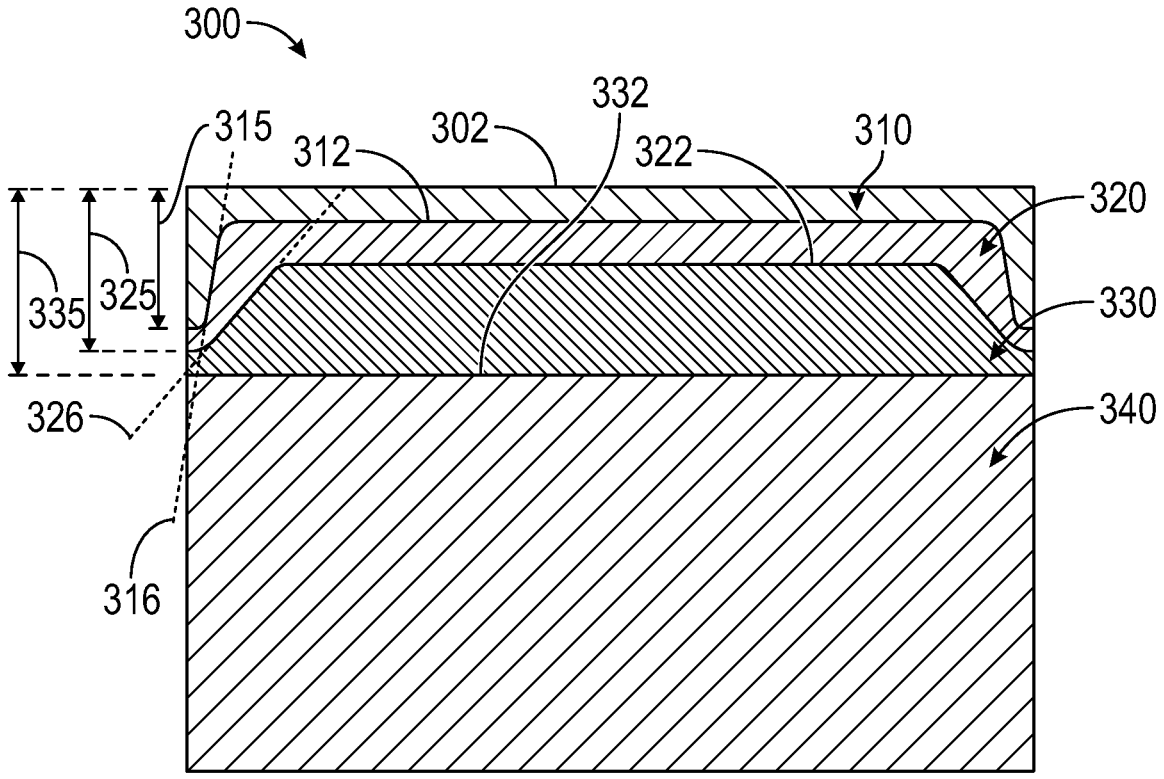
FIG. 4 is a cross-sectional view of a cutting element according to embodiments of the present disclosure.

FIG. 4 shows a cross-sectional view of a cutting element 300 according to embodiments of the present disclosure. The cutting element 300 includes a TSP layer 310, a PCD layer 320, a transition layer 330, and a substrate 340. As described above, the TSP layer 310 may be formed from a PCD layer 320, such as by leaching of the PCD layer 320 to result in a distinct TSP layer 310 and PCD layer 320. While a diamond network may extend uninterrupted between the TSP layer 310 and the PCD layer 320, a microstructure of the cutting element 300 may reveal the distinctions between the two as being the absence (or substantial absence) of a catalyst residing in the interstitial spaces between the bonded-together diamond grains in the TSP layer 310 as compared to the presence of such phase in the PCD layer 320. As shown, TSP layer has a planar cutting face 302 opposite the PCD layer 320. The PCD layer 320 includes a perimeter at the exposed portion thereof that encircles an interior portion (unexposed) of the PCD layer 320. An uppermost portion of the perimeter (closest to the cutting face 302) is a first axial distance 315 from the cutting face 302, which is greater than the axial distance between cutting face 302 and the interior portion of the PCD layer 320, i.e., the uppermost boundary of the PCD layer 320 (the interface 312 between the PCD layer 320 and the TSP layer 310) is non-planar.

A transition layer 330 is disposed between the PCD layer 320 and a substrate 340. The transition layer 330 has a perimeter (the second perimeter) at the exposed portion thereof that encircles an interior portion of the transition layer 330. An uppermost portion of the perimeter of the transition layer 330 (closest to the cutting face 302) is a second axial distance 325 from the cutting face 302, which is greater than the axial distance between the cutting face 302 and the interior portion of the transition layer 330, i.e., the uppermost boundary of the transition layer 330 (the interface 322 between the transition layer 330 and the PCD layer 320) is non-planar. The transition layer 330 further includes a base surface, where the perimeter of the transition layer 330 at the base surface (i.e., perimeter of exposed transition layer furthest from the cutting face 302) is a third axial distance 335 from the cutting face 302 greater than the second axial distance 325.

The second axial distance 325 may range, for example, between 5 percent and 50 percent greater than the first axial distance 315. The third axial distance 335 may range, for example, between 10 percent and 100 percent greater than the first axial distance 315. These distances may also be expressed as relative thicknesses of the exposed portions of TSP layer 310, PCD layer 320, and transition layer 330.

In the embodiment shown, a first interface 312 is formed between the base surface of the TSP layer 310 and the upper surface of the PCD layer 320. The first interface 312 has a non-planar geometry including a stepped profile between the perimeter and interior portion of the PCD layer upper surface. A second interface 322 is formed between the upper surface of the transition layer 330 and the base surface of the PCD layer 320. The second interface 322 has a non-planar geometry including a stepped profile between the perimeter and interior portion of the transition layer upper surface. A third interface 332 is formed between the upper surface of the substrate 340 and the base surface of the transition layer 330. The third interface 332 has a planar geometry.

The stepped profile of a first interface may be different than or the same as the stepped profile of a second interface. For example, as shown in FIG. 4, the stepped profile of the first interface 312 may have a sloped portion with a first slope 316, and the stepped profile of the second interface 322 may have a sloped portion with a second slope 326, where the first slope 316 is greater than (steeper than) the second slope 326.

Figure 5:
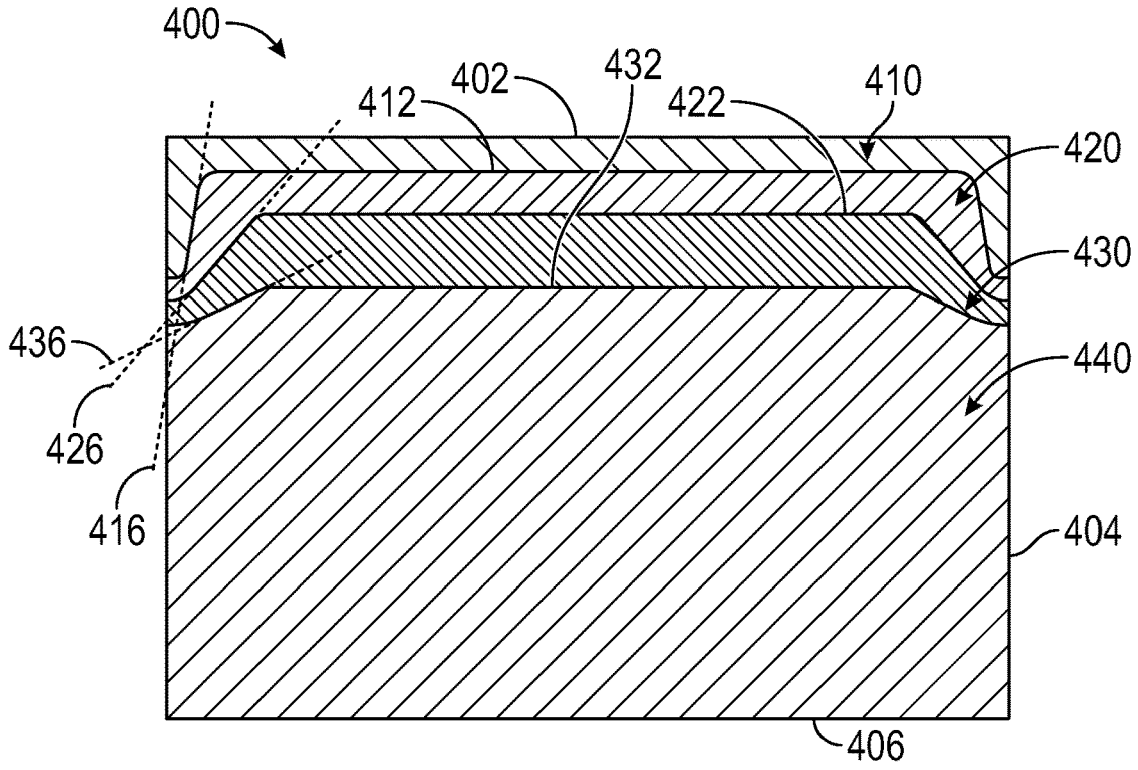
FIG. 5 is a cross-sectional view of a cutting element according to embodiments of the present disclosure.

FIG. 5 shows a cross-sectional view (along an axial plane) of another example of a cutting element 400 according to embodiments of the present disclosure. The cutting element 400 includes a cutting face 402 and a side surface 404 extending from a periphery (the cutting edge) of the cutting face 402 to a base surface 406 of the cutting element 400. A TSP layer 410 of the cutting element 400 forms the cutting face 402 and a portion of the side surface 404 extending an axial distance from the periphery of the cutting face 402. A PCD layer 420 is adjacent to the TSP layer 410 at a first non-planar interface 412 formed between a base surface of the TSP layer 410 and an upper surface of the PCD layer 420. A transition layer 430 is disposed adjacent the PCD layer 420 at a second non-planar interface 422 formed between a base surface of the PCD layer 420 and an upper surface of the transition layer 430. The transition layer 430 is also adjacent a substrate 440 at a third non-planar interface 432 formed between a base surface of the transition layer 430 and an upper surface of the substrate 440.

The TSP layer 410 has a varying thickness measured axially between the cutting face 402 and the first interface 412. The PCD layer 420 has a varying thickness measured axially between the first interface 412 and the second interface 422. The transition layer 430 has a varying thickness measured axially between the second interface 422 and the third interface 432.

Each of the first, second, and third interfaces 412, 422, 432 may have a stepped profile including a step between the perimeter and an interior portion of the interfaces 412, 422, 432, where each step has a different slope. In the embodiment shown, the first interface 412 has a first slope 416, the second interface 422 has a second slope 426, and the third interface 432 has a third slope 436, where the first slope 416 is greater than the second slope 426, and the second slope is greater than the third slope 436. In some embodiments, two or more sloped portions of steps in non-planar interfaces between layers in a cutting element may be the same (e.g., as shown in FIG. 6, discussed below).

The perimeters of the PCD layer 420 and the transition layer 430 are exposed and form portions of the cutting element side surface 404. An exposure thickness of the PCD layer 420 (measured between the perimeter of the first interface 412 and the perimeter of the second interface 422) around the side surface 404 may be less than the exposure thickness of the transition layer 430 (measured between the perimeter of the second interface 422 and the perimeter of the third interface 432) around the side surface 404. In some embodiments, the exposure thickness of a transition layer may be the same as the exposure thickness of a PCD layer in a cutting element. In some embodiments, the exposure thickness of a transition layer may be less than the exposure thickness of a PCD layer in a cutting element. For example, the exposure thickness of a transition layer may be between about 50 percent and 99 percent of a PCD layer exposure thickness around the side surface of a cutting element.

According to embodiments of the present disclosure, the exposure thickness of the transition layer 430 may be less than 75 percent (e.g., between 1 and 75%) of the combined thickness of the TSP and PCD layers exposed around the side surface 404. In some embodiments, the exposure thickness of the transition layer 430 may be less than 30 percent (e.g., between 5 and 25 percent) of the combined thickness of the TSP and PCD layers exposed around the side surface 404.

Figure 6:
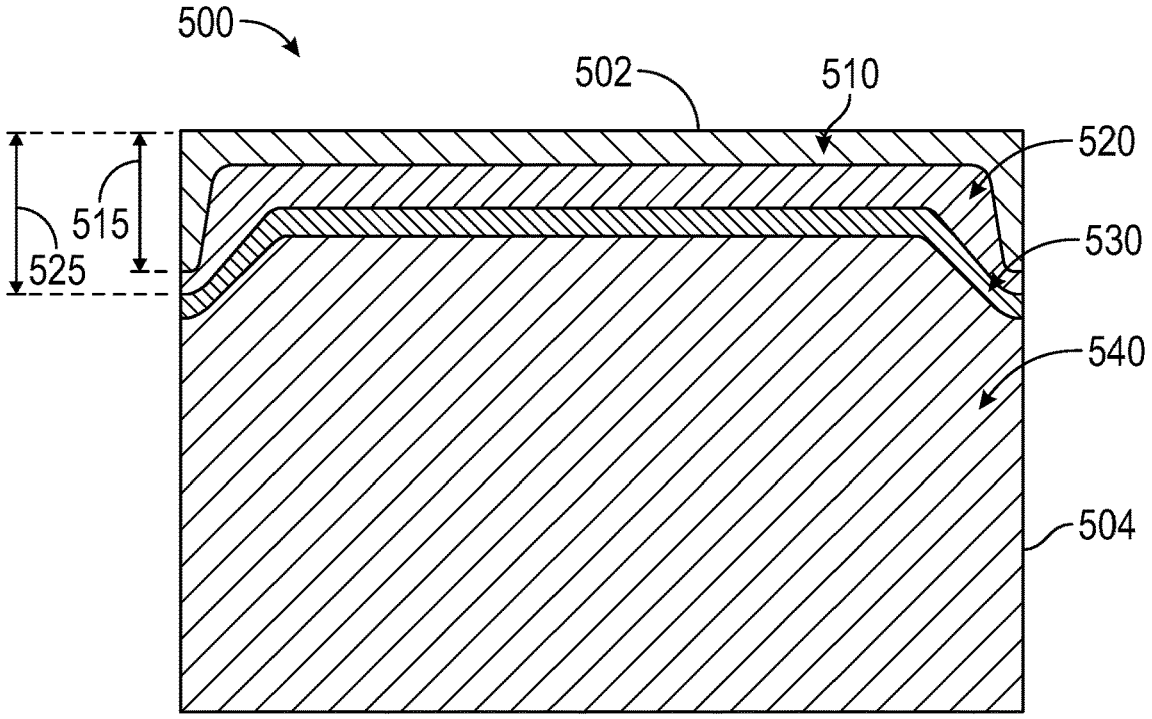
FIG. 6 is a cross-sectional view of a cutting element according to embodiments of the present disclosure.

FIG. 6 shows a cross-sectional view (along an axial plane) of another example of a cutting element 500 according to embodiments of the present disclosure. The cutting element 500 includes a TSP layer 510 formed on a PCD layer 520 and having a planar cutting face 502 opposite the PCD layer 520. The PCD layer 520 includes a perimeter at an exposed portion thereof that encircles an interior portion of the PDC layer 520 that is raised above the PCD layer 520 at the perimeter. An uppermost portion of the PCD layer perimeter is a first axial distance 515 from the cutting face 502, which is greater than the axial distance between the cutting face 502 and the interior portion of the PCD layer 520. A transition layer 530 is disposed between the PCD layer 520 and a substrate 540. The transition layer 530 includes a perimeter at an exposed portion thereof that encircles an interior portion of the transition layer 530 that is raised above the perimeter of the transition layer 530. An uppermost portion of the transition layer at the perimeter is a second axial distance 525 from the cutting face 502, which is greater than the axial distance between the cutting face 502 and the interior portion of the transition layer 530. Further, as shown, the substrate 540 has a non-planar geometry at its upper surface, and thus non-planar interface between the substrate 540 and transition layer 530. As illustrated, the geometry of the interface between the transition layer 530 and the PCD layer 520 is substantially similar to the non-planar interface between the substrate 540 and transition layer 530 such that the transition layer 530 has a substantially uniform thickness in the radial direction.

An exposure thickness of the transition layer 530 around a side surface 504 of the cutting element 500 may be less than or equal to the difference between the first distance 515 and the second distance 525. In some embodiments, the exposure thickness of the transition layer 530 around a side surface 504 of the cutting element 500 may be greater than the difference between the first distance 515 and the second distance 525 and less than 5 times the difference between the first distance 515 and the second distance 525.

Figure 7:
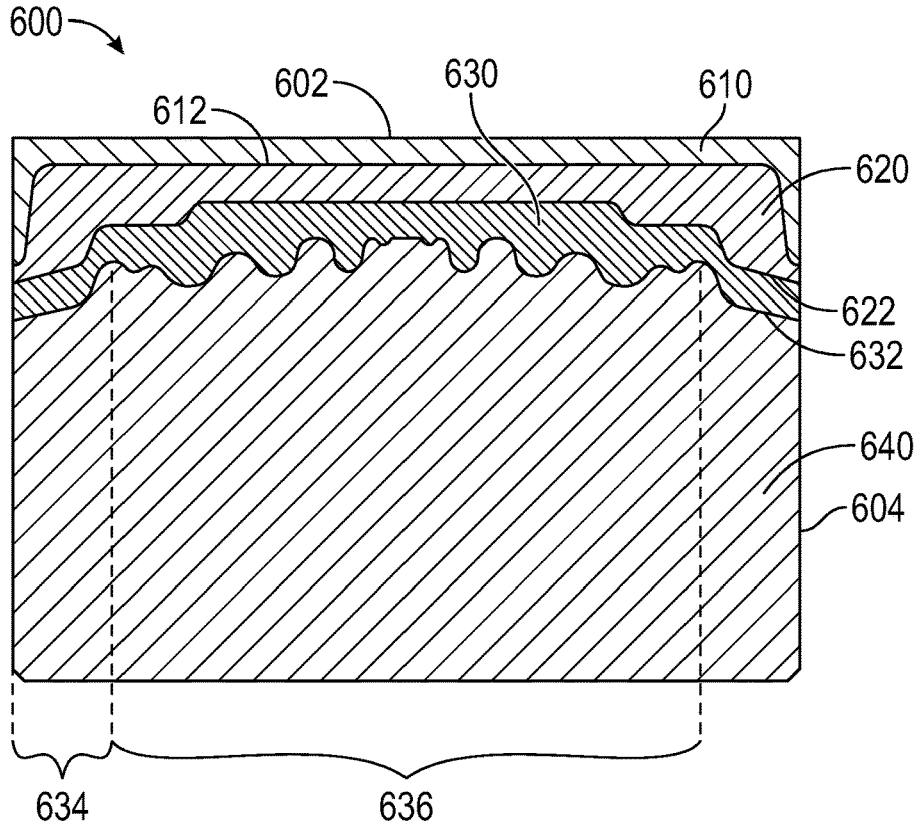
FIG. 7 is a cross-sectional view of a cutting element according to embodiments of the present disclosure.

FIG. 7 shows a cross-sectional view (along an axial plane) of another example of a cutting element 600 according to embodiments of the present disclosure. The cutting element 600 has a cylindrical body having a cutting face 602 and a side surface 604. The cylindrical body includes a substrate 640, a transition layer 630 positioned on the substrate 640 at a first non-planar interface 632, a PCD layer 620 positioned on the transition layer at a second non-planar interface 622 and opposite from the substrate 640, and a TSP layer 610 positioned on the PCD layer 620 at a third non-planar interface 612, wherein the TSP layer 610 forms the cutting face 602 and a portion of the side surface 604.

The first, second and third non-planar interfaces 632, 622, 612 each have a stepped-down perimeter from an interior portion of the first, second and third non-planar interfaces 632, 622, 612. In the embodiment shown, the interior portion of the first interface 632 has raised and depressed features formed therein. It has a stepped portion 634 extending from the perimeter to the interior portion 636, where the stepped portion 634 includes a first turn curved upwards and transitioning to a step and a second curved turn transitioning from the step to the interior portion 636. The interior portion 636 has a plurality of raised and depressed features formed therein. Further, the stepped portion 634 extends uniformly around the circumference of the interior portion 636. In the embodiment shown, the second interface 622 also includes a raised feature formed in its interior portion, while the first interface 612 has a planar interior portion.

Figure 8:
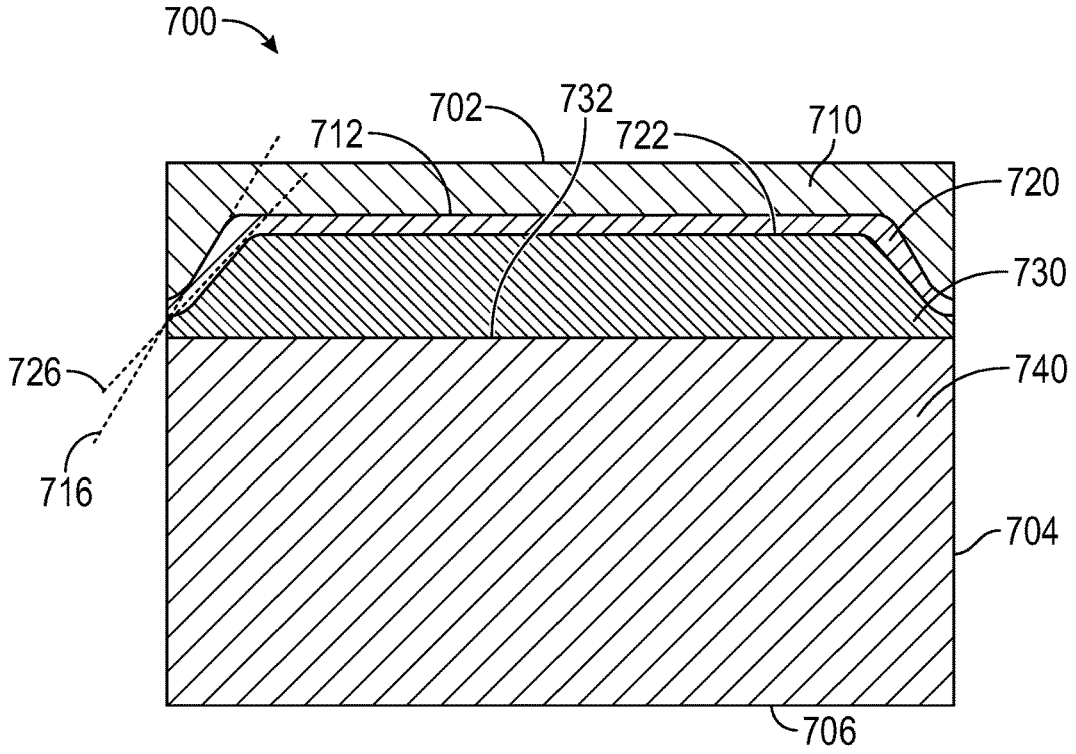
FIG. 8 is a cross-sectional view of a cutting element according to embodiments of the present disclosure.

FIG. 8 shows a cross-sectional view (along an axial plane) of another example of a cutting element 700 according to embodiments of the present disclosure. The cutting element 700 includes a cutting face 702 and a side surface 704 extending from a periphery (the cutting edge) of the cutting face 702 to a base surface 706 of the cutting element 700. A TSP layer 710 of the cutting element 700 forms the cutting face 702 and a portion of the side surface 704 extending an axial distance from the periphery of the cutting face 702. A PCD layer 720 is adjacent to the TSP layer 710, and a first non-planar interface 712 is formed between a base surface of the TSP layer 710 and an upper surface of the PCD layer 720. A transition layer 730 is adjacent to the PCD layer 720, and a second non-planar interface 722 is formed between a base surface of the PCD layer 720 and an upper surface of the transition layer 730. The transition layer 730 is also adjacent to a substrate 740, and a third non-planar interface 732 is formed between a base surface of the transition layer 730 and an upper surface of the substrate 740.

The TSP layer 710 has a varying thickness measured axially between the cutting face 702 and the first interface 712. The PCD layer 720 has a varying thickness measured axially between the first interface 712 and the second interface 722. The transition layer 730 has a varying thickness measured axially between the second interface 722 and the third interface 732.

Each of the first and second interfaces 712 and 722, but not third interface 732 may have a stepped profile including a step between the perimeter and an interior portion of the interfaces 712, 722, where each step has a different slope. In the embodiment shown, the first interface 712 has a first slope 716, the second interface 722 has a second slope 726, and the first slope 716 is greater than the second slope 726. However, as compared to the embodiment illustrated in FIG. 4, for example, the difference between slopes 716 and 726 is less severe. In that manner, while the slope 726 of the second interface 722 in FIG. 8 is shown as being substantially similar to the slope 326 of second interface 322 in FIG. 4, the TSP layer 710 in FIG. 8 is thicker (from both the cutting face 702 and side surface 704) than the TSP layer 310 in FIG. 4. That is, the TSP layer 710 may have a greater leaching depth at both the cutting face 702 and side surface 704. Thus, for example, it is envisioned that the TSP layer 710 may have a thickness (measured from the cutting face and/or the side surface) ranging from 50 microns to 1500 microns, with a lower limit of any of 50, 80, 100, 150, or 250 microns and an upper limit of any of 300, 500, 750, 1000, or 1500 microns, where any lower limit can be used in combination with any upper limit. The radial thickness of the TSP layer 710 at the side surface 704 (i.e., the thickness of the layer measured from the side surface) may be measured at 50% of the axial length of the TSP layer 710. Further, as shown, as the thickness increases, the slope 716 decreases, with an increasing portion of the TSP layer 710 being tapered, rather than parallel to the side surface 704.

The perimeters of the PCD layer 720 and the transition layer 730 are exposed and form portions of the cutting element side surface 704. An exposure thickness of the PCD layer 720 (measured between the perimeter of the first interface 712 and the perimeter of the second interface 722) around the side surface 704 may be less than the exposure thickness of the transition layer 730 (measured between the perimeter of the second interface 722 and the perimeter of the third interface 732) around the side surface 704. In some embodiments, the exposure thickness of a transition layer may be the same as the exposure thickness of a PCD layer in a cutting element. In some embodiments, the exposure thickness of a transition layer may be less than the exposure thickness of a PCD layer in a cutting element. For example, the exposure thickness of a transition layer may be between about 50 percent and 99 percent of a PCD layer exposure thickness around the side surface of a cutting element.

As described above, there may be variations in the diamond body thickness, which includes each diamond containing layer (TSP layer, PCD layer, and transition layer). In one or more embodiments (including each of the embodiments described above), the total diamond body thickness, at the side surface of the cutter ($C_S$) may range from 0.05 to 0.20 inches, e.g., from 0.08 to 0.12 inches. The diamond body thickness at or near the central axis of the cutter ($C_C$) may range from 0.3 $C_S$ to $C_S$, depending on how aggressive the interface between the diamond body and substrate is. The thickness of the transition layer at the side surface of the cutter ($C_{2S}$) may range from 0.05 $C_S$ to 0.5 $C_S$, e.g., from 0.2 $C_S$ to 0.4 $C_S$. Absolute values of $C_{2S}$ may range, for example, from 0.005 to 0.10 inches. The thickness of the transition layer at or near the central axis of the cutter ($C_2$c) may range from 0.05 $C_S$ to 0.8 $C_S$. Absolute vales of $C_{2C}$ may range, for example, from 0.005 to 0.16 inches. The difference between the diamond body thickness and the thickness of the transition layer is equivalent to the combined thickness of PCD and TSP layers.

Table 1, below, summarizes several possible combinations of absolute values of thicknesses of thick and thin diamond bodies as well as thicknesses of transition layers and combined PCD/TSP layers.

TABLE 1

| | | Total diamond body thickness, in. | | Transition layer Thickness, in. | | TSP + PCD layer Thickness, in. | |
|---|---|---|---|---|---|---|---|
| No. | PCD body thickness and aggressiveness of its interface with the carbide substrate | At the side surface | At the central axis | At the side surface | At the central axis | At the side surface | At the central axis |
| 1 | Thin PCD, flat interface | 0.07 | 0.07 | 0.02 | 0.04 | 0.05 | 0.03 |
| 2 | Thin PCD, mild interface | 0.07 | 0.06 | 0.02 | 0.03 | 0.05 | 0.03 |
| 3 | Thin PCD, moderate interface | 0.07 | 0.05 | 0.02 | 0.02 | 0.05 | 0.03 |
| 4 | Thin PCD, aggressive interface | 0.07 | 0.04 | 0.02 | 0.02 | 0.05 | 0.02 |
| 5 | Thick PCD, flat interface | 0.12 | 0.12 | 0.03 | 0.06 | 0.09 | 0.06 |
| 6 | Thick PCD, mild interface | 0.12 | 0.10 | 0.03 | 0.05 | 0.09 | 0.05 |
| 7 | Thick PCD, moderate interface | 0.12 | 0.08 | 0.03 | 0.04 | 0.09 | 0.04 |
| 8 | Thick PCD, aggressive interface | 0.12 | 0.06 | 0.03 | 0.03 | 0.09 | 0.03 |

The TSP layer is formed from the PCD precursor by leaching or otherwise removing/converting the metal present in the interstitial spaces of the diamond network into a more thermally stable form. The leaching depth (thickness of the leached volume in the direction perpendicular to the surface of the body) and thus depth of the TSP layer, may be in the range of 50 to 1500 μm (0.002-0.060 inches). In some embodiments, the leaching depth may range from 50 to 100 μm (0.002-0.004 inches); in some embodiments, the depth may range from 300 to 500 μm (0.012-0.020 inches); and in some embodiments, the depth may range from 500 to 1500 μm (0.020-0.060 inches). Cutters with different leaching depths but the same geometry of combined TSP+PCD layer and transition layers are shown on FIGS. 4 and 8. In FIG. 4, the leached volume (TSP layer) forms about 50% of the volume of the combined TSP+PCD layer, whereas in FIG. 8, the leached volume (TSP layer) forms about 90% of the volume of the combined TSP+PCD layer.

Methods of the present disclosure may include sintering together a substrate, one or more transition layers, and a PCD layer to form a cutting element having one or more transition layers disposed between the PCD layer and substrate. In some embodiments, a cutting element having one or more transition layers disposed between a substrate and a PCD layer may be provided.

According to embodiments of the present disclosure, initial material for sintering a transition layer may include a mixture of diamond particles and non-diamond particles. The non-diamond particles may be selected from constituents of the substrate material (such as carbide particles when an adjacent substrate is a carbide substrate). In some embodiments, non-diamond particles may be selected from refractory metals, carbides, borides, and nitrides. The transition layer may include at least 1 percent by volume of small size non-diamond particles, having a size at least 4 times smaller than a majority of the diamond particles.

A portion of the PCD layer of a cutting element may be leached in a manner to leave a layer of un-leached PCD material, such that the leached portion does not contact a transition layer. In other words, a portion of the PCD layer of a cutting element may be leached such that the resulting cutting element has a PCD layer disposed between a TSP layer and a transition layer. Further, methods of the present disclosure may include leaching the cutting face, cutting edge, and a portion of the side surface of the PCD layer in a cutting element, such that the interface between the resulting TSP layer and PCD layer is non-planar and has a geometry that bends downward toward the substrate of the cutting element near the perimeter of the interface.

Example 1

Two groups of cutters of diameter 0.625" were made using a high pressure-high temperature sintering technique. Two different diamond powder mixtures were prepared and used for sintering top and transition layers in these cutters. After high-pressure sintering, the transition layers had a coarser structure and a lower diamond volume content compared to the top layer. In the first group of cutters, a flat interface between the top PCD and transition layers were formed. In the second group, the PCD/transition layer interface bended downwards approaching the cutter's side surface (according to embodiments of the present disclosure, e.g., as shown in FIG. 6). In both groups, the same carbide substrate with relatively aggressive interface was used. The total PCD body thickness was 0.10" at the side surface and 0.05" at the central axis of the cutter. Table 2 summarizes absolute values of thicknesses of PCD body as well as thicknesses of transitional and top layers for each group of cutters.

TABLE 2

| No. | Geometry of the interface between top and transition layers | PCD body thickness, in. | | Transitional layer Thickness, in. | | Top layer Thickness, in. | |
|---|---|---|---|---|---|---|---|
| | | At the side surface | At the central axis | At the side surface | At the central axis | At the side surface | At the central axis |
| 1 | Flat | 0.10 | 0.05 | 0.06 | 0.01 | 0.04 | 0.04 |
| 2 | Bended downwards | 0.10 | 0.05 | 0.025 | 0.025 | 0.075 | 0.025 |

Both groups of cutters were then leached to around 400 μm (0.016") at the cutting face and the side surface of each cutter to form a TSP layer. The side wrap (extent of leaching down the side surface from the cutting face towards the substrate) was about 1500 μm (0.060") for each cutter. Thus, in the cutters with flat interface between the layers, the leached layer extended partially into the transition layers, while in the cutters with a bending interface (according to embodiments of the present disclosure) the leached layer was entirely inside the PCD layer.

The wear resistance of cutters was tested by cutting a block of granite in a vertical turret lathe and measuring the wear scar area of the cutters. Cutters with a bending interface between the PCD and transition layers according to embodiments of the present disclosure showed a higher average wear score compared to cutters with the flat interface, namely, about 1.15 times higher than cutters with a flat interface between the PCD and transition layers.

Spalling resistance of the cutters were tested by dropping cutters with an impact energy level of 50 J. Cutters were brazed into holders with a 20° back rake angle. Cutters with the bending interface between the PCD and transition layers according to embodiments of the present application showed higher average number of impacts till failure compared to cutters with the flat interface, namely, about 1.2 times higher than cutters with a flat interface between the PCD and transition layers.

In some embodiments, by using cutter with a transition layer interface according to the present disclosure, both impact resistance and wear resistance are improved when compared to a cutter where there is a planar interface between a transition layer and a PCD layer.

One or more specific embodiments of the present disclosure are described herein. These described embodiments are examples of the presently disclosed techniques. In an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, or within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. Although only a few example embodiments have been described in detail above, those skilled in the art will readily appreciate that many modifications are possible in the example embodiments without materially departing from this invention. Accordingly, all such modifications are intended to be included within the scope of this disclosure.

What is claimed:

1. A cutting element, comprising:

a polycrystalline diamond layer;

a thermally stable polycrystalline diamond layer at a side of the polycrystalline diamond layer and having a planar cutting face opposite the polycrystalline diamond layer;

a transition layer at a side of the polycrystalline diamond layer opposite the thermally stable polycrystalline diamond layer; and a non-planar interface between the transition layer and the polycrystalline diamond layer, the non-planar interface comprising a perimeter exposed around a side surface of the cutting element and encircling an interior of the non-planar interface and an uppermost portion of the perimeter being an axial distance from the planar cutting face greater than an axial distance between the planar cutting face and the interior.

2. The cutting element of claim 1, further comprising a second non-planar interface formed between the thermally stable polycrystalline diamond layer and the polycrystalline diamond layer, wherein the second non-planar interface comprises a second perimeter exposed around the side surface of the cutting element and encircling a second interior of the second non-planar interface, and wherein an uppermost portion of the second perimeter is a second axial distance from the planar cutting face, the second axial distance being greater than an axial distance between the planar cutting face and the second interior.

3. The cutting element of claim 1, wherein an exposure thickness of the transition layer around the side surface of the cutting element is less than an exposure thickness of the polycrystalline diamond layer around the side surface.

4. The cutting element of claim 3, wherein the exposure thickness of the transition layer is between 5 and 50 percent of the combined thickness of the thermally stable polycrystalline diamond layer, the polycrystalline diamond layer, and the transition layer at the side surface.

5. The cutting element of claim 1, wherein a thickness of the transition layer adjacent a central axis of the cutting element may range from 5 to 80 percent of the combined thickness of the thermally stable polycrystalline diamond layer, the polycrystalline diamond layer, and the transition layer adjacent the central axis.

6. A cutting tool comprising a tool body and at least one cutting element of claim 1 thereon.

7. A cutting element, comprising:

a diamond body, the diamond body comprising:

a leached portion at a planar cutting face of the cutting element; and an unleached portion;

a transition layer adjacent to the unleached portion of the diamond body; and a non-planar interface between the diamond body and the transition layer, the non-planar interface comprising a perimeter around a side surface of the cutting element, the perimeter being an axially lowermost portion of the non-planar interface from the planar cutting face, wherein the diamond body has a thickness between the planar cutting face and the non-planar interface that is greater proximate the side surface of the cutting element than proximate a central axis of the cutting element.

8. The cutting element of claim 7, wherein an exposure thickness of the transition layer around a side surface of the cutting element is between 5 and 50 percent of a combined thickness of the diamond body and the transition layer at the side surface.

9. The cutting element of claim 7, wherein a thickness of the transition layer adjacent the central axis of the cutting element may range from 5 to 80 percent of a combined thickness of the diamond body and the transition layer adjacent the central axis.

10. The cutting element of claim 7, further comprising a substrate on a side of the transition layer opposite the diamond body.

11. The cutting element of claim 7, wherein the transition layer comprises a mixture of diamond particles and non-diamond particles, the non-diamond particles selected from refractory metals, carbides, borides, nitrides, or combinations thereof.

12. The cutting element of claim 11, wherein the transition layer comprises at least 3 percent by volume of non-diamond particles having a size at least 4 times smaller than a majority of the diamond particles.

13. The cutting element of claim 7, wherein the transition layer has a greater thickness adjacent the central axis of the cutting element than at the side surface.

14. A cutting tool comprising a tool body and at least one cutting element of claim 7 thereon.

15. A cutting element, comprising a cylindrical body having a planar cutting face and a side surface, the cylindrical body comprising:

a substrate;

a transition layer on the substrate;

a polycrystalline diamond layer at a first non-planar interface with the transition layer opposite the substrate; and a thermally stable polycrystalline diamond layer adjacent the polycrystalline diamond layer opposite the transition layer, the thermally stable polycrystalline diamond layer forming the planar cutting face and a portion of the side surface, a cutting edge formed at an intersection of the planar cutting face and the side surface, the first non-planar interface comprising a geometry having a downwardly sloped portion from an interior to a perimeter, the perimeter extending entirely around the side surface of the cutting element and having a greater axial distance from the planar cutting face than an axial distance to the planar cutting face at the interior.

16. The cutting element of claim 15, wherein an interface between the transition layer and the substrate is planar.

17. The cutting element of claim 15, wherein a second non-planar interface is formed between the thermally stable polycrystalline diamond layer and the polycrystalline diamond layer, the second non-planar interface comprising a geometry having a second downwardly sloped portion from a second interior to a second perimeter, the second perimeter extending entirely around the side surface of the cutting element and being relatively farther from the cutting face than the second interior.

18. The cutting element of claim 17, wherein a first slope of the downwardly sloped portion of the first non-planar interface is less than a second slope of the second downwardly sloped portion of the second non-planar interface.

19. The cutting element of claim 15, wherein a third non-planar interface between the transition layer and the substrate comprises a geometry having a third downwardly sloped portion from a third interior to a third perimeter, the third perimeter extending entirely around the side surface of the cutting element and being relatively farther from the cutting face than the third interior.

20. A cutting tool comprising a tool body and at least one cutting element of claim 15 thereon.

* * * * *